US009613505B2

(12) United States Patent
Martinson et al.

(10) Patent No.: US 9,613,505 B2
(45) Date of Patent: Apr. 4, 2017

(54) OBJECT DETECTION AND LOCALIZED EXTREMITY GUIDANCE

(71) Applicant: TOYOTA JIDOSHA KABUSHIKI KAISHA, Toyota-shi, Aichi-ken (JP)

(72) Inventors: Eric Martinson, Mountain View, CA (US); Emrah Akin Sisbot, Mountain View, CA (US); Joseph Djugash, San Jose, CA (US); Kentaro Oguchi, Menlo Park, CA (US); Yutaka Takaoka, Toyota (JP); Yusuke Nakano, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 41 days.

(21) Appl. No.: 14/658,138

(22) Filed: Mar. 13, 2015

(65) Prior Publication Data

US 2016/0267755 A1 Sep. 15, 2016

(51) Int. Cl.
*G08B 6/00* (2006.01)

(52) U.S. Cl.
CPC ..... *G08B 6/00* (2013.01)

(58) Field of Classification Search
CPC ..... G08B 6/00; G01C 21/00; G01C 21/20; G06K 9/4638; G06K 9/00201
USPC ..... 340/407.1, 539.1, 539.13, 573.1; 345/156; 701/412
See application file for complete search history.

(56) References Cited

U.S. PATENT DOCUMENTS

| | | | |
|---|---|---|---|
| 6,198,395 | B1 | 3/2001 | Sussman |
| 6,320,496 | B1 | 11/2001 | Sokoler et al. |
| 6,486,784 | B1 | 11/2002 | Beckers |
| 6,662,141 | B2 | 12/2003 | Kaub |
| 6,744,370 | B1 | 6/2004 | Sleichter, III et al. |
| 6,774,788 | B1 | 8/2004 | Balfe |
| 7,610,151 | B2 | 10/2009 | Letchner et al. |
| 7,986,828 | B2 | 7/2011 | Rao et al. |
| 8,166,421 | B2 | 4/2012 | Magal et al. |
| 8,583,661 | B2 | 11/2013 | Fujii et al. |

(Continued)

OTHER PUBLICATIONS

Xia et al., "Human Detection Using Depth Information by Kinect," Computer Vision and Pattern REcognition Workshops, 2011 IEEE Computer Society Conference on IEEE, 2011 (8 pages).

(Continued)

*Primary Examiner* — Hung T Nguyen
(74) *Attorney, Agent, or Firm* — Patent Law Works LLP

(57) ABSTRACT

Technology for localized guidance of a body part of a user to specific objects within a physical environment using a vibration interface is described. An example system may include a vibration interface wearable on an extremity by a user. The vibration interface includes a plurality of motors. The system includes sensor(s) coupled to the vibrotactile system and a sensing system coupled to the sensor(s) and the vibration interface. The sensing system is configured to analyze a physical environment in which the user is located for a tangible object using the sensor(s), to generate a trajectory for navigating the extremity of the user to the tangible object based on a relative position of the extremity of the user bearing the vibration interface to a position of the tangible object within the physical environment, and to guide the extremity of the user along the trajectory by vibrating the vibration interface.

21 Claims, 11 Drawing Sheets

(56) References Cited

U.S. PATENT DOCUMENTS

| | | | | |
|---|---|---|---|---|
| 9,141,852 | B1 | 9/2015 | Cosgun et al. | |
| 9,202,353 | B1 | 12/2015 | Sisbot et al. | |
| 2002/0076100 | A1 | 6/2002 | Luo | |
| 2003/0037720 | A1 | 2/2003 | Stockton | |
| 2004/0091153 | A1 | 5/2004 | Nakano et al. | |
| 2004/0210358 | A1 | 10/2004 | Suzuki et al. | |
| 2006/0129308 | A1 | 6/2006 | Kates | |
| 2006/0149621 | A1 | 7/2006 | Do et al. | |
| 2008/0004802 | A1 | 1/2008 | Horvitz | |
| 2008/0112592 | A1 | 5/2008 | Wu et al. | |
| 2008/0120025 | A1 | 5/2008 | Naitou et al. | |
| 2008/0120029 | A1 | 5/2008 | Zelek et al. | |
| 2008/0312709 | A1 | 12/2008 | Volpe et al. | |
| 2009/0252423 | A1 | 10/2009 | Zhu et al. | |
| 2010/0013612 | A1* | 1/2010 | Zachman | A61F 11/04 340/407.1 |
| 2010/0106603 | A1 | 4/2010 | Dey et al. | |
| 2010/0302138 | A1 | 12/2010 | Poot et al. | |
| 2010/0332126 | A1 | 12/2010 | Huang et al. | |
| 2011/0044506 | A1 | 2/2011 | Chen | |
| 2011/0054781 | A1 | 3/2011 | Ohkubo | |
| 2011/0210915 | A1 | 9/2011 | Shotton et al. | |
| 2011/0213628 | A1 | 9/2011 | Peak et al. | |
| 2011/0249865 | A1 | 10/2011 | Lee et al. | |
| 2011/0307172 | A1 | 12/2011 | Jadhav et al. | |
| 2011/0309926 | A1 | 12/2011 | Eikelenberg et al. | |
| 2011/0317871 | A1 | 12/2011 | Tossell et al. | |
| 2012/0050324 | A1* | 3/2012 | Jeong | G06F 17/30 345/633 |
| 2012/0070070 | A1 | 3/2012 | Litvak | |
| 2012/0095681 | A1 | 4/2012 | An et al. | |
| 2012/0150429 | A1 | 6/2012 | Siotos | |
| 2012/0184884 | A1 | 7/2012 | Dyer et al. | |
| 2013/0000156 | A1 | 1/2013 | Andoh | |
| 2013/0218456 | A1 | 8/2013 | Zelek et al. | |
| 2013/0265225 | A1 | 10/2013 | Nasiri et al. | |
| 2013/0317944 | A1 | 11/2013 | Huang et al. | |
| 2014/0009268 | A1 | 1/2014 | Oshima et al. | |
| 2014/0018985 | A1 | 1/2014 | Gupta et al. | |
| 2014/0114574 | A1 | 4/2014 | Tertoolen et al. | |
| 2014/0180526 | A1 | 6/2014 | Deshpande et al. | |
| 2014/0266571 | A1 | 9/2014 | Sharma et al. | |
| 2014/0267648 | A1* | 9/2014 | Wexler | G09B 21/006 348/62 |

OTHER PUBLICATIONS

U.S. Appl. No. 14/012,170, filed Aug. 28, 2013, entitled "Tactile Belt System for Providing Navigation Guidance."

Balachandran et al., "A GPS Based Navigation Aid for the Blind," 17th International Conference on Applied Electromagnetics and Communications, Croatia, Oct. 1-3, 2003, pp. 34-36.

Edwards et al., "A Pragmatic Approach to the Design and Implementation of a Vibrotactile Belt and Its Applications," Haptic Audio Visual Environments and Games, IEEE International Workshop, 2009 (6 pages).

Heuten et al., "Tactile Wayfinder: A Non-Visual Support System for Wayfinding," Proceedings: NordiCHI 2008, Oct. 20-22, 2008, 10 pages.

Koenig, "Toward Real-Time Human Detection and Tracking in Diverse Environments," Development and Learning, IEEE 6th International Conference, 2007 (5 pages).

Kulyukin et al., "A Robotic Wayfinding System for the Visually Impaired," Proceedings of the National Conference on Artificial Intelligence, 2004 (6 pages).

Melvin et al., "ROVI: A Robot for Visually Impaired for Collision-Free Navigation," Proceedings of the International Conference on Man-Machine Systems (ICoMMS), Malaysia, Oct. 11-13, 2009, 6 pages.

Pandey et al., "Towards a Sociable Robot Guide which Respects and Supports the Human Activity," 5th Annual IEEE Conference on Automation Science and Engineering, India, Aug. 22-25, 2009, 6 pages.

Pielot et al., "Evaluation of Continuous Direction Encoding with Tactile Belts," Haptic and Audio Interaction Design. Springer Berlin Heidelberg, 2008 (10 pages).

Rosenthal et al., "Design Implementation and Case Study of a Pragmantic Vibrotactile Belt," Instrumentation and Measurement, IEEE Transactions, 2011 (10 pages).

Spinello et al., "A Layered Approach to People Detection in 3D Range Data," AAAI 2010 (6 pages).

Tsukada et al., "ActiveBelt: Belt-type Wearable Tactile Display for Directional Navigation," UbiComp 2004: Ubiquitous Computing 2004 (16 pages).

Ulrich et al., "The GuideCane—Applying Mobile Robot Technologies to Assist the Visually Impaired," IEEE Transactions on Systems, Man and Cybernetics—Part A: Systems and Humans, vol. 31, No. 2, Mar. 2001 pp. 131-136.

Van Erp et al., "Waypoint Navigation with a Virobtactile Waist Belt," ACM Transactions on Applied Perception, vol. 2, No. 2, Apr. 2005, pp. 106-117.

Fritsch, et al., "Multi-modal anchoring for human-robot interaction," Robotics and Autonomous Systems 43 (2003) p. 133-147.

Hwang et al., "The Haptic Steering Wheel: Vibro-tactile based Navigation for the Driving Environment," Pervasive Computing and Communications Workshops (PERCOM Workshops), 2010 8th IEEE International Conference on IEEE, 2010 (6 pages).

Rempel, "Glasses That Alert Travelers to Objects Through Vibration? An Evaluation of iGlasses by RNIB and AmbuTech," AFB AccessWorld Magazine, vol. 13, No. 9, Sep. 2012, http://www.afb.org/afbpress/pub.asp?DocID=aw130905.

Scheggi et al., "Vibrotactile haptic feedback for human-robot interaction in leader-follower tasks," in PETRA, Crete Island, Greece, 2012.

Lieberman et al., "TIKL: Development of a Wearable Vibrotactile Feedback Suit for Improved Human Motor Learning," IEEE Transactions on Robotics, vol. 23, No. 5, pp. 919-926, Oct. 2007.

Sergi et al., "Forearm orientation guidance with a vibrotactile feedback bracelet: On the directionality of tactile motor communication," in Proc. of the Int. Conf. on Biomedical Robotics and Biomechatronics, Scottsdale, AZ, 2008, pp. 133-138.

Guinan et al., "Back-to-back skin stretch feedback for communicating five degree-of-freedom direction cues," in IEEE World Haptics Conference, Daejeon, Korea, 2013.

Bark et al., "Rotational Skin Stretch Feedback: A Wearable Haptic Display for Motion," IEEE Transactions on Haptics, vol. 3, No. 3, pp. 166-176, Jul. 2010.

Rotella et al., "HAPI Bands: A haptic augmented posture interface," in HAPTICS Symposium, Vancouver, BC, 2012.

* cited by examiner

OBJECT DETECTION AND LOCALIZED EXTREMITY GUIDANCE

BACKGROUND

The present application relates to object detection and localized extremity guidance.

Recently, smart watches have been a very active area of research and development and various companies have released capable wrist-worn computers. For the blind, these wearable smart devices can be used to communicate event-based knowledge. For example, a watch can vibrate on the hour to indicate the passage of time, or vibrate in response to an incoming phone call instead of ringing. Vibration around the wrist is generally un-intrusive, but still informative.

The type of vibration used to alert a user can also be varied to convey different information. In U.S. Pre-grant publication 2006/0129308 A1 (US308), a system is described where different vibrations convey limited information about different types of objects detected in the environment using RFID tag-readers, such as identification codes identifying the objects. This information is relayed to a computer which makes use of it, such as alerting the user to the existence of a dangerous condition (e.g., a fire) using vibration. However, while US308 discusses the possibility of using the information from the RFID modules to ascertain the direction of travel, speed, and path of the user, US308 does not disclose any particular methods for computing the speed and path of the user, or using the path computation to guide an extremity of a user to and/or around object(s). Rather, US308 is limited to generally describing using RFID tags to define a grid, which is used to track a user's general movements.

Some tactile belt systems employ a haptic interface around the waist of a user for communicating directions in new environments and thus guiding people, such as those who are visually impaired, along arbitrarily complex paths. These systems are designed to work with robot(s) as a guide, which can detect obstacles or potentially other locations of interest using existing techniques, and guide the user to designated areas. However, the directional feedback provided by such a system is not localized and thus lacks adequate directional definition in some cases. In addition, such a guide robot can be complex and require extensive setup, training, and maintenance.

A system described by J. Rempel, "Glasses That Alert Travelers to Objects Through Vibration? An Evaluation of iGlasses by RNIB and AmbuTech," AFB AccessWorld Magazine, vol. 13, no. 9, Sep. 2012 (Rempel), uses glasses configured to alert the visually impaired about objects using vibration. These glasses detect objects that may be in the path of the user using ultrasound, and vibrate to indicate their proximity and left or right direction relative to the objects. However, the system described by Rempel is inadequate for localized guidance as it provides even less well-defined directional information than the above belt system.

Thus, the above-described systems are limited to providing coarse-grained navigational assistance which is unsuitable for localized guidance, such as guiding a hand to a particular target. Furthermore, they are not integrated with object detection to find specific objects of interest a user may want to grab, which is not a trivial task.

In a related area, some systems use vibrotactile feedback for human-robot interaction, such as leader-follower scenarios involving multiple robots as described by S. Scheggi, F. Chinello, and D. Prattichizzo, "Vibrotactile haptic feedback for human-robot interaction in leader-follower tasks," in PETRA, Crete Island, Greece, 2012 (Scheggi). In particular, Scheggi demonstrates how bracelets equipped with three vibro motors worn by the human leader of a human robot team can be used to improve team cohesion. The robots track the human's path, velocity, and expected trajectory, and warn the human when his/her motion would make following impossible. However, the system described by Scheggi does not guide the human to a particular location using vibration, but rather constrains his/her motions based on robot feedback. In addition, the system is incapable of detecting objects and/or guiding a person to those objects, and is thus not suitable for localized guidance applications.

Various techniques also exist for teaching people new motor skills for use in sports training, dancing, fixing bad posture, or some forms of physical therapy, such as therapy provided after the occurrence of a stroke. Traditionally, a trainer would watch a given pupil and give the pupil feedback including spoken directions, visual demonstrations, and manually moving the pupil's limbs into the right location. But paying for such training or therapy is expensive and unattainable for many people. As a result, researchers have begun developing computerized haptic interfaces to guide a person's motion, and therefore increase the quality and consistency of the training, and the number of people who have access to it.

Currently, researchers are investigating which haptic interface is the most suitable for teaching motor skills. For instance, the system described in J. Lieberman and C. Breazeal, "TIKL: Development of a Wearable Vibrotactile Feedback Suit for Improved Human Motor Learning," IEEE Transactions on Robotics, vol. 23, no. 5, pp. 919-926, October 2007, uses vibration motors placed about the wrist and upper arm of a given person to help that person achieve the desired positioning of his/her arm. The system uses a room-mounted computer vision system configured to track the person's arm relative to a given orientation and uses vibration to help position the arm along the appropriate axis. In this way, a person's arm could be pushed into the right location using vibration.

Another system described by F. Sergi, D. Accoto, D. Compolo, and E. Guglielmelli, "Forearm orientation guidance with a vibrotactile feedback bracelet: On the directionality of tactile motor communication," in Proc. of the Int. Conf. on Biomedical Robotics and Biomechatronics, Scottsdale, Ariz., 2008, pp. 133-138, uses vibrotactile feedback with a single bracelet to guide an arm along a trajectory, and explores various configurations for such a bracelet. Other implementations, such as those described by A. L. Guinan, N. C. Hornbaker, M. N. Montandon, A. J. Doxon, and W. Provancher, "Back-to-back skin stretch feedback for communicating five degree-of-freedom direction cues," in IEEE World Haptics Conference, Daejeon, Korea, 2013 and K. Bark, J. Wheeler, P. Shull, J. Savall, and M. Cutkosky, "Rotational Skin Stretch Feedback: A Wearable Haptic Display for Motion," IEEE Transactions on Haptics, vol. 3, no. 3, pp. 166-176, July 2010, use skin stretch instead of vibration as another modality for guiding hands into a desired rotational form. The system described by M. F. Rotella, K. Guerin, Xingchi He, and A. M. Okamura, "HAPI Bands: A haptic augmented posture interface," in HAPTICS Symposium, Vancouver, BC, 2012 uses a set of five bands placed around a person's wrists, elbows and waist, which guide the person to a correct posture (e.g., Yoga) in response to a computer vision-based analysis. This system uses a Kinect™ camera to estimate the person's body skeleton and generate vibrational error.

While some of above haptic systems may be designed to use vibratory feedback to achieve particular postures and/or actions, these systems lack the capability to detect objects in the environment and provide localized navigational assistance to the user to reach out and manipulate detected objects.

SUMMARY

Technology for localized guidance of a body part of a user to specific objects within a physical environment using a vibration interface is described.

According to one innovative aspect of the subject matter described in this disclosure, a system includes a vibration interface wearable on an extremity by a user. The vibration interface includes a plurality of motors. The system includes sensor(s) coupled to the vibrotactile system and a sensing system coupled to the sensor(s) and the vibration interface. The sensing system is configured to analyze a physical environment in which the user is located for a tangible object using the sensor(s), to generate a trajectory for navigating the extremity of the user to the tangible object based on a relative position of the extremity of the user bearing the vibration interface to a position of the tangible object within the physical environment, and to guide the extremity of the user along the trajectory by vibrating the vibration interface.

The system and further implementations may each optionally include one or more of the following features. For instance, the system may include: an input device configured to receive input data from the user indicating the tangible object; that the input device is coupled to the sensing system to communicate data reflecting the tangible object to the sensing system; that the one or more sensors are further configured to receive transponder signals from the tangible object; that the transponder signals include identification data identifying the tangible object; that the sensing system is executable by the one or more processors to determine a unique identity of the tangible object based on the identification data; that the one or more sensors include a perceptual system configured to capture image data including images of the physical environment and any objects located within the physical environment; that the perceptual system is coupled to the sensing system to provide the image data including the images; that the sensing system is further configured to process the image data to determine a location of the tangible object; that the sensing system is further configured to determine the relative position of the extremity of the user bearing the vibration interface; that the sensing system is further configured to sense movement of the extremity by the user using the one or more sensors, to re-determine the relative position of the extremity of the user to the tangible object responsive to sensing the movement, to update the trajectory for navigating the extremity of the user to the tangible object based on a change to the relative position of the extremity of the user to the tangible object, and to guide the extremity of the user along the updated trajectory, as updated, using the vibration interface; that the vibration interface includes a plurality of motors; that the sensing system is further configured to determine a vibratory pattern for vibrating one or more of the motors of the vibration interface based on the trajectory generated for navigating the extremity of the user to the tangible object and to vibrate the vibration interface by vibrating the one or more motors according to the vibratory pattern to convey the direction for movement of the extremity to reach the tangible object; a motor control unit configured to vibrate the motors of the vibration interface according to the vibratory pattern determined by the sensing system; that the motor control unit is coupled to the sensing system to receive control signals.

In general, another innovative aspect of the subject matter described in this disclosure may be embodied in methods that include: analyzing a physical environment in which a user bearing a vibration interface is located for a tangible object using one or more sensors; determining a relative position of the extremity of the user bearing the vibration interface to a position of the tangible object within the physical environment; generating a trajectory for navigating the extremity of the user to the tangible object based on the relative position of the extremity to the position of tangible object; and guiding the extremity of the user along the trajectory by vibrating the vibration interface.

The method and further implementations may each optionally include one or more of the following features. For instance, the system may include: sensing movement of the extremity by the user using the one or more sensors; responsive to sensing the movement, re-determining the relative position of the extremity of the user to the tangible object; updating the trajectory for navigating the extremity of the user to the tangible object based on a change to the relative position of the extremity of the user to the tangible object; guiding the extremity of the user along the trajectory, as updated, by vibrating the vibration interface; that determining the relative position of the extremity includes determining an orientation of the extremity using sensing data captured by the one or more sensors, the sensing data reflecting movement of the extremity by the user, calculating a ray originating from a predetermined point of the extremity and extending through a predetermined point of the tangible object, and calculating an angular offset θ between the orientation of the extremity and the ray; that generating the trajectory for navigating the extremity of the user to the tangible object is based on the angular offset; that the vibration interface includes a plurality of motors and guiding the extremity of the user along the trajectory includes vibrating one or more of the motors of the vibration interface; that determining a vibratory pattern for vibrating the one or more of the motors of the vibration interface based on the trajectory generated for navigating the extremity of the user to the tangible object; that guiding the extremity of the user along the trajectory by vibrating the vibration interface further includes vibrating the one or more motors according to the vibratory pattern to convey the direction for movement of the extremity to reach the tangible object; that the vibratory pattern includes one or more of linear motion and rotational dimensions and vibrating the one or more motors of the vibration interface includes vibrating the one or more motors based on the one or more of the directional and rotational dimensions of the vibratory pattern to convey the direction for movement of the extremity to reach the tangible object; identifying a bit sequence and vibration intensity value for the one or more motors; that the bit sequence and vibration intensity value reflect the one or more of the directional and rotational dimensions of the vibratory pattern; that vibrating the one or motors of the vibration interface includes vibrating the one or more motors using the bit sequence and vibration intensity value; determining that the extremity of the user has reached the position of the tangible object within the physical environment; terminating vibrating the vibration interface to cease guiding the extremity of the user; that the position of the tangible object is fixed or variable; that determining the relative position of the extremity of the user to the position of the tangible object within the physical environment includes determining a central position of the tangible object, determining a centroid of the vibration interface, and calculating the relative position based on a distance between the central position of object and the centroid of vibration interface; identifying an obstacle within the physical environment between the tangible object and the extremity of the user using the one or more sensors; that generating the trajectory for navigating the extremity of the user to the tangible object based on the relative position of the extremity to the position of tangible object is further based on a path that circumnavigates the obstacle; that analyzing the physical environment in which the user is located for the tangible object using one or more sensors includes locating the tangible object within the physical environment using a visual perception system; detecting an operational problem associated with the vibration interface; determining a unique vibratory pattern for the operational problem; vibrating the vibration interface based on the unique vibratory pattern; receiving input from user via an input device providing assistance to address the operational problem; and receiving input data from a user via an input device indicating the tangible object as an object of interest.

Other aspects include corresponding methods, systems, apparatus, and computer program products for these and other innovative aspects.

The technology described by the present disclosure may be particularly advantageous in a number of respects. For instance, the technology is capable of guiding an extremity of a user, such as the user's hand, to a given object in the environment. This is beneficial, and in some cases critical, when the target subject is blind, visually impaired, or otherwise incapable of discerning the surrounding environment or objects clearly. In a further example, the technology may guide the user's hand to detected objects out of the user's line-of-sight, providing guidance for difficult to see objects, or as a teaching guide for explaining manipulation tasks with new or unknown objects.

The above list of features and advantages is not all-inclusive and many additional features and advantages are within the scope of the present disclosure. Moreover, it should be noted that the language used in the present disclosure has been principally selected for readability and instructional purposes, and not to limit the scope of the subject matter disclosed herein.

BRIEF DESCRIPTION OF THE DRAWINGS

The disclosure is illustrated by way of example, and not by way of limitation in the figures of the accompanying drawings in which like reference numerals are used to refer to similar elements.

DETAILED DESCRIPTION

Vision is an important aspect of reaching for, and grasping an object. A person depends on their eyes to provide feedback on relative positioning, and identify how to move their hand. For a visually impaired person, this feedback is missing either completely or to a significant degree. To find the small everyday objects that he or she uses, a visually impaired person generally depends on those objects being located in the same place. Dishes, for example, are always put back in the same spot, and it is important to not fall behind on putting them away. When the person is in a new environment or is looking for objects that get moved around by other people in the environment, the person is relegated to spend a significant amount of time groping around with his/her hands or asking for assistance.

This disclosure describes novel technology for assisting users to find objects using localized guidance. The technology combines real-time computational object detection with vibration (e.g., haptic) interface(s) worn on the extremit(ies) (e.g., wrist, ankle, neck, waist, etc.) that guide the extremit(ies) to the object location(s) using vibration. In an example, the vibration interface can guide the hand of a person to a detected object in the environment, and, although the person may not be able to perceive the object (e.g. they are blind, line-of-sight is obstructed, they are unfamiliar with the object, etc.), the technology detects the object relative to the person's hand and then it guides the hand to the object of interest by providing vibratory feedback through motors embedded in a wristband.

Figure 1:
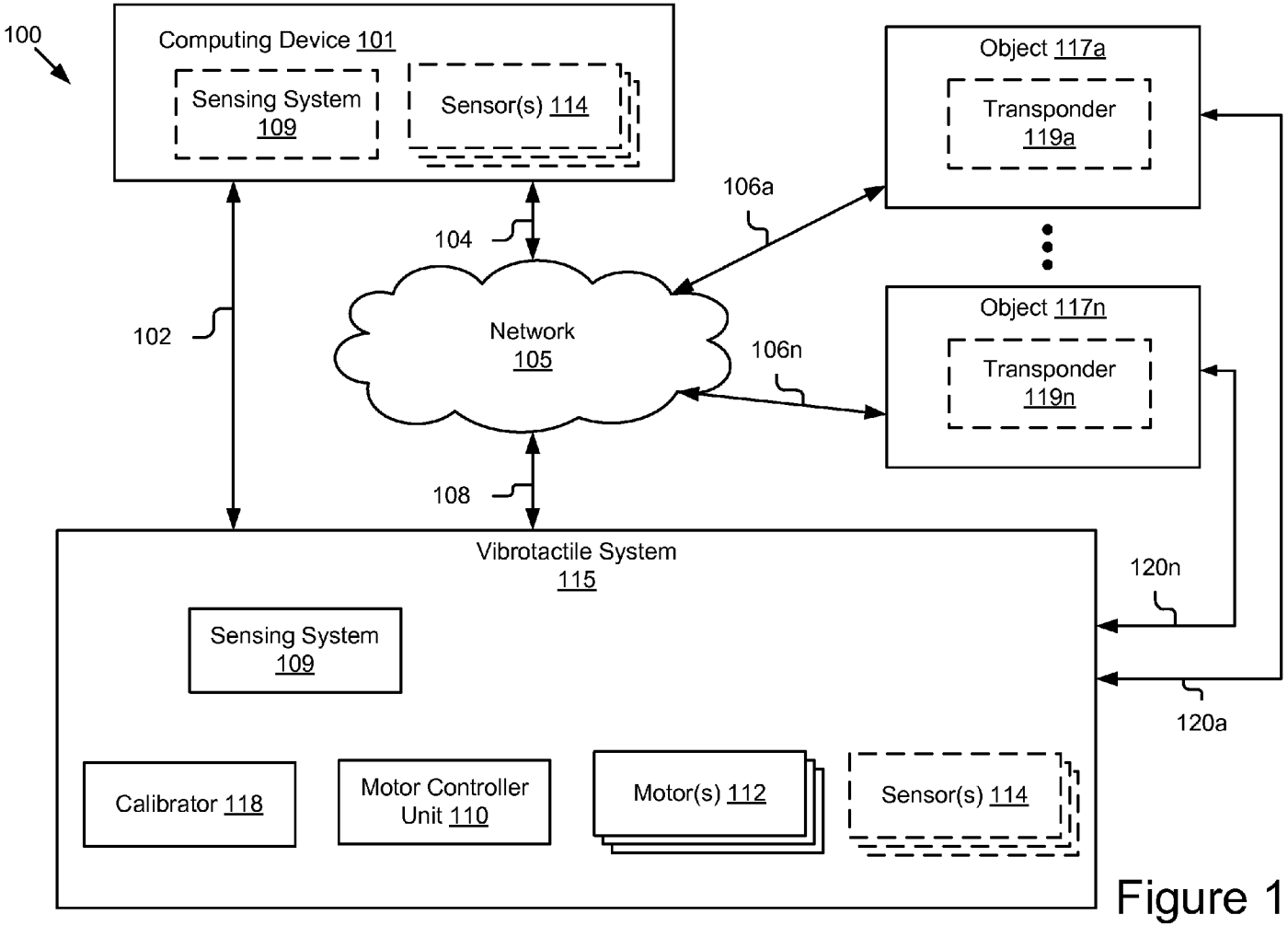
FIG. 1 is a block diagram illustrating an example sensing system for object detection and localized extremity guidance.

The technology includes a sensing system 100 configured to determine the relative position of vibration interface(s) worn by the user to target object(s). FIG. 1 illustrates a block diagram of an example of one such sensing system 100, which is configured to detect objects and provide localized extremity guidance. The illustrated system 100 includes one or more vibration interface(s), termed vibrotactile system(s) 115, that can be worn and accessed by a user, a computing device 101 that can be accessed by one or more users, and tangible objects 117*a* . . . 117*n*. In the illustrated implementation, these entities of the system 100 are communicatively coupled via a network 105. In some embodiments, the system 100 may include other entities not shown in FIG. 1 including various client and server devices, data storage devices, etc. In addition, while the system 100 is depicted as including a single user device 101, a single vibrotactile system 115, and a plurality of objects 117*a* . . . 117*n*, the system 100 may include any number of these objects.

The part(s) of the user's body on which the vibration interface(s) are worn are referred to herein as extremities. Example extremities include a wrist, ankle, knee, leg, arm, waist, neck, head, prosthetic, assistive device (e.g., cane), or other appendage, etc. The vibration interface(s) are configured to provide dynamic, real-time sensory feedback to the user. The implementations described herein use vibrational feedback produced by motors included in the vibration interface(s), although it should be understood that other types of feedback produce by suitable devices are also possible, such as electrostatic feedback, pressure-based feedback, etc.

Figure 2:
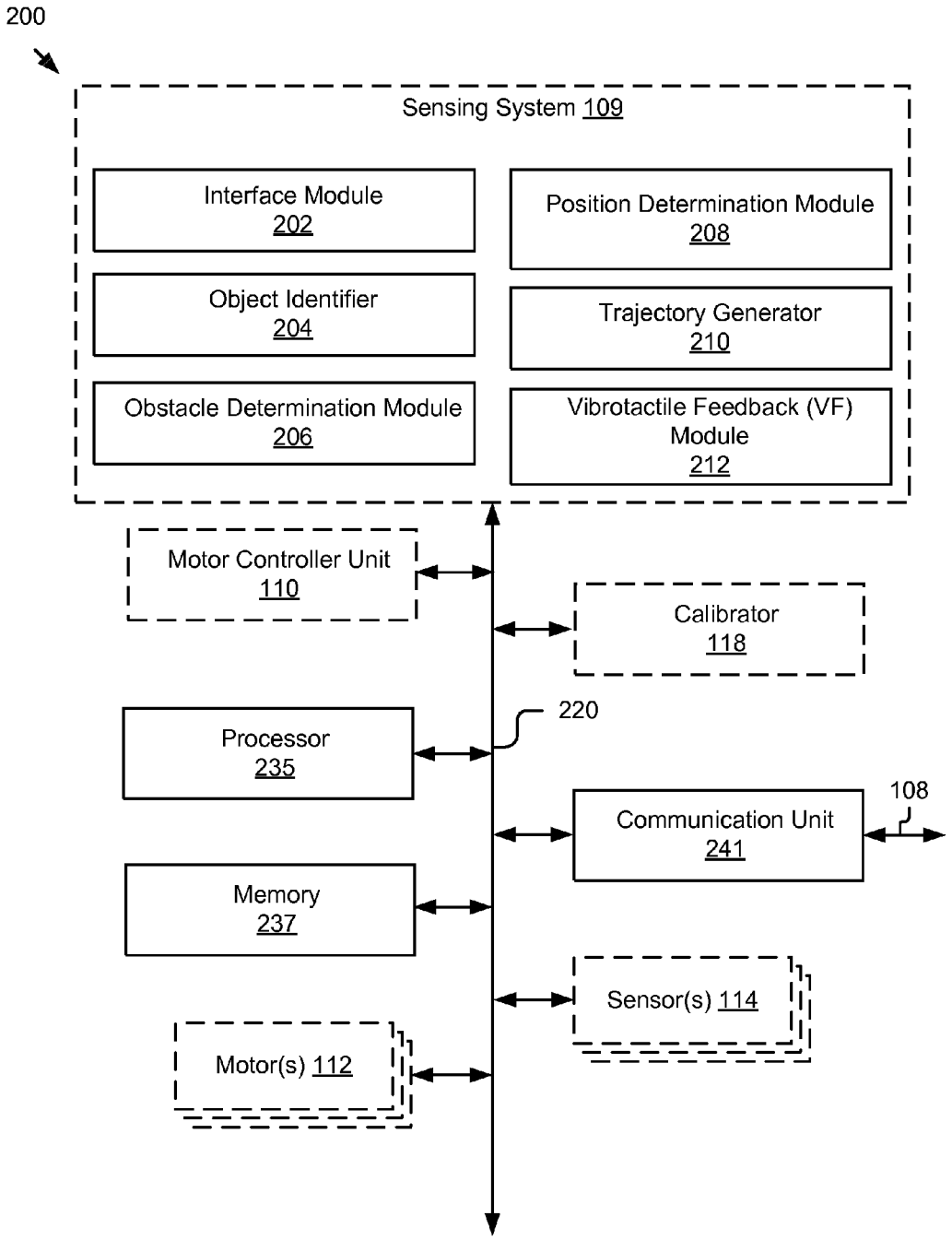
FIG. 2 is a block diagram illustrating an example vibrotactile system.
Figure 7A:
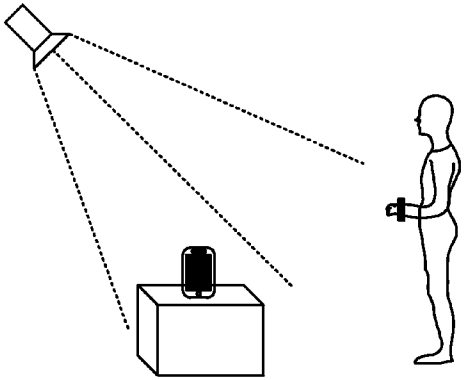
FIGS. 7A-7D are diagrams illustrating example perceptual systems capable of providing relative positioning.

The technology includes one or more perceptual systems for sensing the environment and detecting the objects within it. In some implementations, a perceptual system may include a vision system (e.g., depth-based skeletal tracking systems, range-based arm detection systems, and/or visual detection in RGB-D images) that can capture and process 2D and 3D depth images for objects and provide that information to the sensing system 109 (the object identifier 204), which can identify the objects by matching attributes of the objects in the images to corresponding pre-stored attributes in a data storage, such as the memory 237. In some implementations, the perceptual system may include an digital image capture device capable of capturing still and motion images, and may include a lens for gathering and focusing light, a photo sensor including pixel regions for capturing the focused light and a processor for generating image data and/or detecting objects based on signals provided by the pixel regions. The photo sensor may be any type of photo sensor including a charge-coupled device (CCD), a complementary metal-oxide-semiconductor (CMOS) sensor, a hybrid CCD/CMOS device, etc. In FIGS. 1 and 2, the perceptual system may be represented as a sensor 114. By way of further example, in various implementations, the perceptual system may comprise:

An external camera coupled to electronically communicate with a corresponding vibration interface, such as an external RGB or depth imaging system mounted in the environment (e.g. on the ceiling) that can capture both the vibration interface worn by the user and the target object(s). The sensing system 100 can use the data captured by the external camera to compute a relative position between the vibration interface and a given target object, and use that position to guide the user's extremity to the object of interest. An example of this implementation is depicted in FIG. 7A.

Figure 7B:
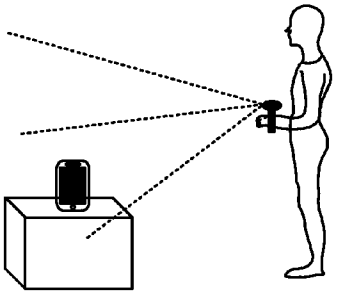
Figure 7C:
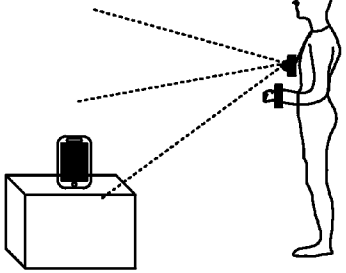

An embedded camera embedded in the vibration interface (e.g., wristband), which can capture object(s) of interest. The sensing system 100 can use the data captured by the embedded camera to guide the extremity on which the interface is being worn to the object(s). An example of this implementation is depicted in FIG. 7B. In this example, since the point of reference of the camera is the position of the vibration interface in which the camera is embedded, the location of the vibration interface, and thus the location of the extremity, is known relative to objects within the field of the view of the camera and does not need to be dynamically determined, although extremity orientation information may be in some cases.

A separate user-worn camera coupled to electronically communicate with a corresponding vibration interface, such as a necklace camera worn about the neck of the individual, could capture object(s) in the environment. Combined with extremity position information from a sensor (e.g., inertial measurement unit (IMU)) embedded in the vibration interface (e.g., wristband), the sensing system 100 can determine the relative position of the extremity to the target object(s). In a further, example, the camera may include a wide-angle lens configured to capture/track both the hand position and the object position, and the sensing system 100 could use the captured data to determine relative position information (e.g., without necessitating the IMU and using a single sensor), as discussed elsewhere herein.

Figure 7D:
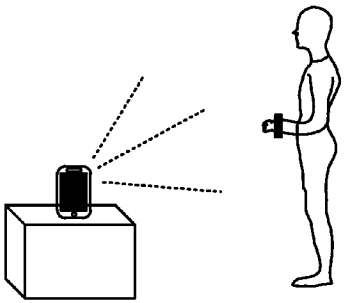

An embedded signal generator, also called a transponder 119, embedded in an object, which can eliminate the need for a camera in some implementations. An example transponder 119 may include an active or passive RFID transmitter, or other suitable signal generator. As shown in FIG. 1, transponders 119*a* . . . 119*n* may be embedded in various objects 117*a* . . . 117*n* in the environment. One or more receivers (e.g., a sensor 114) embedded in the vibration interface or a corresponding device (a portable electronic device electronically paired to the vibration interface) can then detect the relative position(s) (e.g., location and/or orientation) of the signal generator(s) and the sensing system 100 can use the information to guide the user to the transmitter(s). An example of this implementation is depicted in FIG. 7D.

The technology can indicate the direction of motion that will allow the user to most easily reach an object using vibrotactile feedback. In an example, sensors worn by the person (e.g., on one or more extremities) and/or mounted in the surrounding room, can be used to search for an object of interest when a spoken command is issued and captured by the sensing system 100. Once the object is found, and its relative position to the user's extremity (e.g., hand) is established, a vibration interface (e.g., bracelet/wristband) worn on the wrist of the individual vibrates using various patterns to indicate the direction the extremity needs to travel to reach the object.

Figure 10:
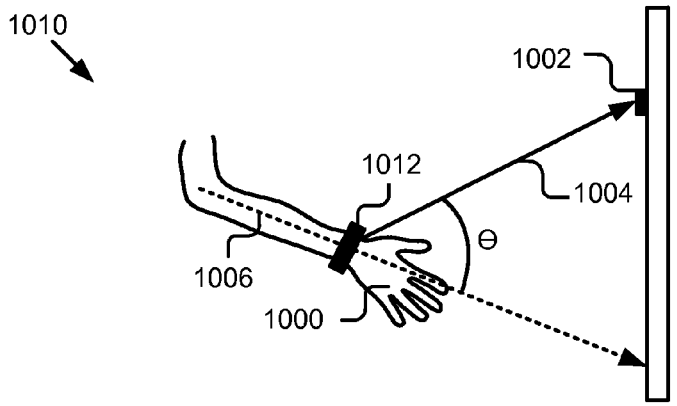
FIG. 10 is a diagram illustrating an example angular offset between a current orientation of the user's extremity and a desired trajectory.

FIG. 10 is a diagram illustrating an example angular offset θ between a current orientation 1006 of the user's extremity and a desired trajectory 1004. In the depicted environment 1010, the sensing system 100 identifies which motors in the vibration interface 1012 should vibrate based on the angular offset θ from the current orientation 1006 of the extremity 1000 (e.g., arm) to the desired trajectory 1004—in this case a straight line—to the object 1002. For instance, in this environment 1010, a blind individual is searching for an elevator button 1002, an object whose relative position can vary greatly from location to location. A perceptual system, such as a camera mounted on the individual's chest and detects the button 1002 in the environment 1010 and the relative position of the person's hand 1000 to the button 1002. When the orientation of the forearm/hand 1006 is not lined up with the object (an imaginary line extending from the elbow through the center of the bracelet does not intersect with the object), the sensing system 100 can calculate the angular offset θ and use it to activate up/down, left/right, forward/backward, etc., motion to bring the hand 1000 in line with the object.

Figure 11A:
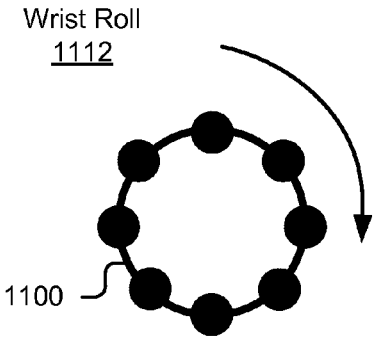
FIGS. 11A-11B are diagrams illustrating various example movements conveyable by an example vibration interface.
Figure 11B:
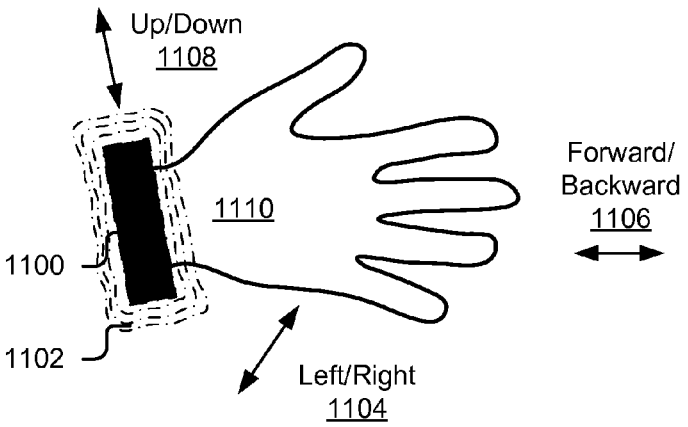

A vibration interface may contain multiple vibration motors (also called vibrotactile motors or just motors) which it can control to convey various vibratory patterns corresponding with different movements to be undertaken by the bearer of the interface. For instance, the motors individually and/or cooperatively produce the vibratory patterns (also called signals) that convey the different movements. A vibratory pattern may include a magnitude and/or linear and/or rotational dimensions. By following the directions associated with the vibratory patterns, an individual can find and grasp/touch otherwise unseen objects in the environment. By way of example, FIGS. 11A-11B are diagrams illustrating different vibratory patterns conveyable by an example vibration interface 1100 in association with different movements. In the depicted example, the vibration interface 1100 is a bracelet configured to convey the vibratory patterns, and/or combinations thereof, using some number of motors, although the vibration interface 1100 can take other forms, be worn on other body parts, and have other configurations, as discussed elsewhere herein. As shown, the patterns and associated movements include up/down, left/right, forward/backward, and roll. Example signals include:

- Left/right—a left vibration or right vibration produced by vibration motor(s) closest to the left or right side of the user's extremity (e.g., wrist) (from the user's perspective), respectively, given the current position of the extremity as indicated by one or more sensors (e.g., gyroscope, accelerometer, radio-frequency-based location device (e.g., BLE, Wi-Fi™, etc.).
- Up/down—a top vibration or a bottom vibration produced by vibration motor(s) closest to the top (up) or the bottom (down) of the user's extremity (e.g., wrist) (from the user's perspective), given the current position of the extremity as indicated by one or more sensors (e.g., gyroscope, accelerometer, radio-frequency-based location device (e.g., BLE, Wi-Fi™, etc.).
- Forward/backward—a constant vibration or a pulsing vibration produced by vibration motor(s) to respectively indicate moving forward or backward along the current orientation of the extremity (e.g., arm), given the current position of the extremity as indicated by one or more sensors (e.g., gyroscope, accelerometer, radio-frequency-based location device (e.g., BLE, Wi-Fi™, etc.).
- Wrist roll—a rolling/rotational vibration produced by vibrating a series of vibration motors in sequence in a left-to-right or right-to-left direction (from the perspective of the user) to indicate the desired direction of motion (e.g., wrist roll), given the current orientation of the extremity user's extremity (e.g., wrist) as indicated by a sensor (e.g., gyroscope).

It should be understood that the above patterns are non-limiting and provided by way of illustration, and that other patterns are contemplated and encompassed by the scope of this disclosure, such as a lack of vibration, varying pulses, combinations of different motors to indicate complex motion (e.g. a combination of left and up), and varying the intensity of vibration to indicate distance to the detected object.

Figure 8C:
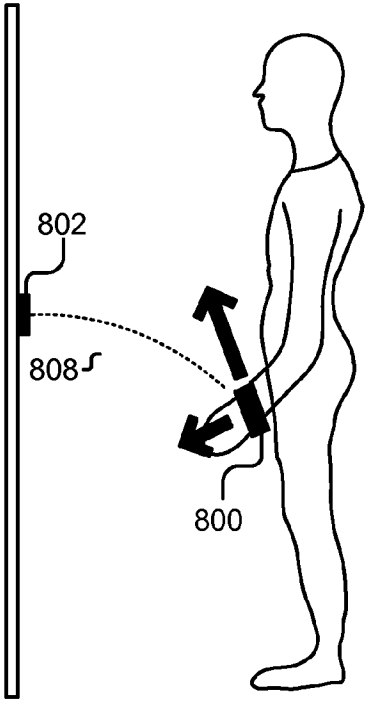
FIGS. 8A-8C are diagrams illustrating examples of different trajectories generated for guiding a user's hand towards a target.
Figure 8B:
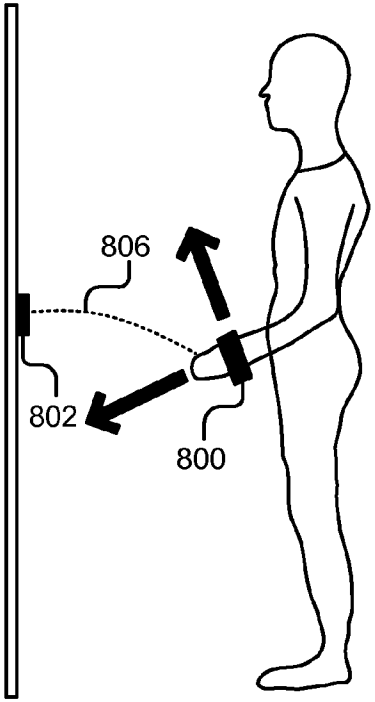
Figure 8A:
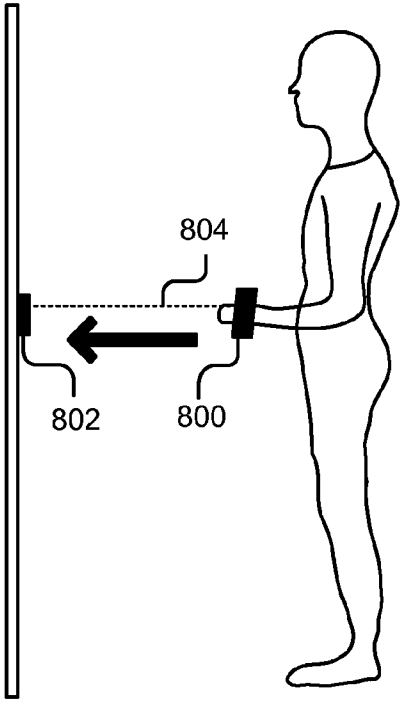

The types of trajectories that can be followed by the wrist worn vibration interface 100 based on the conveyed vibratory patterns are varied. FIGS. 8A-8C are diagrams illustrating examples of different trajectories generated for guiding a user's extremity, in this case a hand, towards a target object detected by the sensing system 109 using the sensor(s) 114. In particular, FIG. 8A shows a straight line trajectory from the current position of the user's extremity (e.g., hand) to the detected object (e.g., elevator button) in the environment and FIGS. 8B and 8C show two different curved (more complex) trajectories based on the different starting/current positions of the user's extremity to the detected object (e.g., elevator button) in the environment.

FIGS. 8A-8C also show how vibrotactile feedback can change relative to the orientation and/or location of the arm. In FIG. 8C, the arm needs to move upwards and forwards to reach the target and the sensing system 100 provides corresponding vibration signals to guide the user's hand along the trajectory 808 to the target 802. In FIG. 8B, relative to FIG. 8C, the arm still needs to move upwards and forwards, although about equally now. In FIG. 8A, relative to FIG. 8B, the arm is lined up with the object, and only forward motion is necessary to reach the target.

In some implementations, the sensing system 100 can adjust the vibration level (the amount of vibration the user feels) as a function of the position of the vibration interface relative to a target to indicate how much the user needs to move the extremity in a given direction. For instance, as the user's moves the extremity in response to the vibrational feedback, the vibration interface 800 can adapt the intensity of the vibration to indicate the amount of upward or forward motion is still necessary to reach to the target, although other suitable signals instructing the user about his/her progress are also possible (e.g., frequency of pulses, other signal types, etc.).

Figure 9:
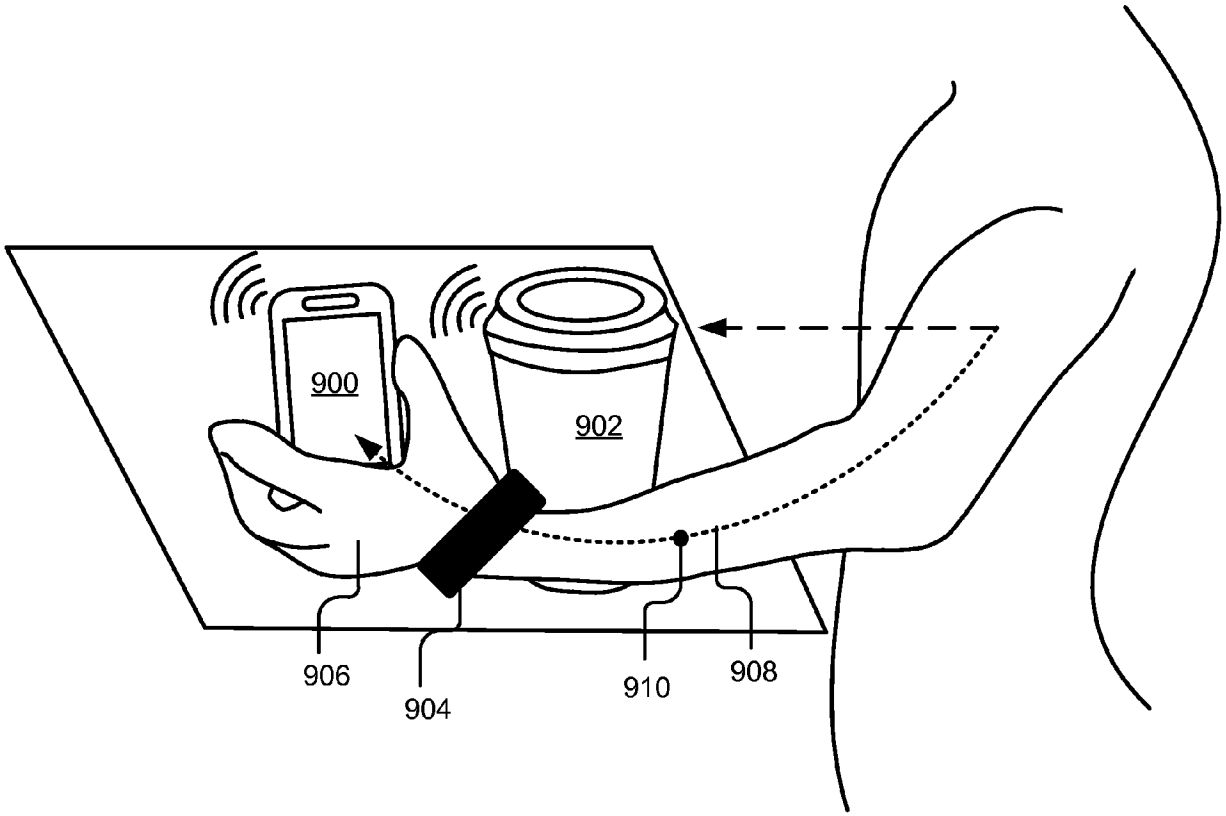
FIG. 9 is a diagram showing the guidance of a user's hand around an obstacle to a target object.

As a further example, FIG. 9 is a diagram showing the guidance of a user's hand 906 around an obstacle 902 to a target object 900. The sensing system 100 senses the environment/field and detects an intervening object 902 is located between the user's hand 906 and a target object 900. Responsive to the objection detection, the sensing system 100 generates a trajectory/path 908 including intermediate waypoint(s) 910 guiding the user's hand around the obstacle 902. The generated trajectory communicated to the user via the vibration interface 904, and guides the user's hand (from the user's perspective) forward to the left around the obstacle 902 (cup) and then forward to the right in from of the obstacle (cup) so the user's hand 906 can interact with the target object 900 (phone). While a single obstacle 902 and target object 900 are discussed in this example, it should be understood that the sensing system 100 can detect many obstacles and notify the user of many target objects.

In addition to the sensing system 100 communicating different movements through vibratory motors mounted to one or more extremities, the motors can also be used to convey the internal state of the vibrotactile system 115 to the human bearer. For instance, if the sensing system 100 has lost the location of a human bearer or is otherwise unable to track objects and/or the bearer due to calibration, lost self-localization, etc., a unique vibratory pattern can be generated by the vibrotactile system 115 (e.g., the same motor set) so that the human knows that the sensing system 100 is in need of human assistance. In response, the human can act appropriately to aid in the track recovery. Further examples of internal states that can be conveyed to the user through alternative patterns of motion include processing issues or delays, configuration issues, communication delays, changes or updates to the current planned trajectory, certain communications from other nodes or objects, etc.

Returning to FIG. 1, the network 105 may include any number of computer networks and/or network types. For example, the network 105 may include, but is not limited to, one or more local area networks (LANs), wide area networks (WANs) (e.g., the Internet), virtual private networks (VPNs), wireless wide area network (WWANs), WiMAX® networks, personal area networks (PANs) (e.g., Bluetooth® communication networks), various combinations thereof, and/or any other interconnected data path across which multiple devices may communicate. The network 105 may also include a mobile network, such as for wireless communication via, for example, GSM, LTE, HSDPA, WiMAX®, etc.

The computing device 101 has data processing and communication capabilities and is coupled to the network 105 via signal line 104 for communication and interaction with the other entities of the system, such as the vibrotactile system 115 and/or the objects 117*a* . . . 117*n*. The computing device 101 may also be coupled to the vibrotactile system 115 via signal line 102 representing a direct connection, such as a wired connection and/or interface.

The computing device 101 is representative of various different possible computing devices and/or systems. Depending on the implementation, the computing device 101 may represent a client or server device. In addition, while a single computing device 101 is depicted, it should be understood that multiple computing devices 101 may be included in the system and coupled for communication with one another either directly or via the network 105. For instance, one computing device 101 may be a remote server accessible via the network from another local computing device 101, such as a consumer device. Examples of various different computing devices 101 include, but are not limited to, mobile phones, tablets, laptops, desktops, netbooks, kiosks, server appliances, servers, virtual machines, smart TVs, set-top boxes, media streaming devices, portable media players, navigation devices, personal digital assistants, custom electronic devices, embeddable/embedded computing systems, etc.

The vibrotactile system may be coupled to the network 105 for communication with the other entities of the system 100 via signal line 108. The vibrotactile system 115 includes a user-wearable electro-mechanical system configured to provide vibratory feedback to the user based on objects detected in the environment surrounding the user wearing the vibrotactile system 115. The vibrotactile system 115 includes a user-wearable portion about a body part. In some implementations, the user-wearable portion includes an encircling member that the user can don about the body part, such as a band, strap, belt, bracelet, etc. The body part may include an extremity, such as an hand, wrist, arm, ankle, knee, thigh, neck, head, prosthesis, or any other natural or artificial body part that can guided by the user using his/her motor skills. The user-wearable portion includes a set of vibration motors 112, also simply referred to as motors, controlled by a motor controller unit 110. The motors 112 singly and/or cooperatively produce signals (vibration patterns) to communicate various information to the bearer of the system 115, such as environmental and operational information. For example but not limitation, the motor(s) 112 may produce certain unique vibratory patterns, each of which signaling a particular direction in which the user should move the extremity bearing the user-wearable portion and the level in which the user should move in that direction, as discussed elsewhere herein. Other signals are also possible, as discussed elsewhere herein.

The vibrotactile system 115 also has a control portion including a sensing system 109, a calibrator 118, and the motor control unit 110. The sensing system 109 includes software and/or hardware logic executable to receive and process sensing data from the sensor(s) 114 and provide instructions to the motor control unit 110. In turn, the motor control unit 110 interprets the instructions and activates and deactivates the motor(s) 112 and/or the intensity of the motor vibration to produce the vibrational feedback corresponding to the instructions. The motor control unit 110 includes hardware and/or software logic to perform its functionality and is electrically coupled to the motor(s) to send and/or receive electrical signals to and/or from the motor(s). The sensing system 109 is coupled to the sensor(s) 114 via a wired and/or wireless connection to receive the sensing data.

The sensor(s) 114 are device(s) configured to capture, measure, receive, communicate, and/or respond to information. The sensor(s) 114 may be embedded in the user-wearable portion of the vibrotactile system 115 and/or included in another element of the system 100, such as the computing device 101 and/or another object in the environment. Example sensor(s) 114 include, but are not limited to, an accelerometer, a gyroscope, an IMU, a photo sensor capable of capturing graphical (still and/or moving image) data, a microphone, a data receiver (e.g., GPS, RFID, IrDA, WPAN, etc.), a data transponder (e.g., RFID, IrDA, WPAN, etc.), a touch sensor, a pressure sensor, a magnetic sensor, etc.

The calibrator 118 includes hardware and/or software logic executable to calibrate the motor(s) 112 to produce accurate vibratory feedback. The motor controller unit 110 is coupled to and interacts with the calibrator 118 to calibrate the motor(s) 112. The calibrator 118 may retrieve vibratory pattern parameters for a given vibratory pattern from the memory 127 and measure and compare corresponding aspects of the pattern as produced by the motor controller unit 110 in association with the motor(s) 112 with the parameters to determine compliance. For any aspects outside of the corresponding parameters, the calibrator 118 may adjust the current operational conditions of one or more of the motor(s) 112 so the vibratory pattern meets performance expectations.

The objects 117*a* . . . 117*n* include any tangible objects that may be included in an environment and that users can interact with and/or use. The objects may be everyday objects that a person would use or could include specialized objects that are intended to serve a particular purpose. For instance, as the technology discussed herein can be used as, but is not limited to, assistive technology for individuals that have various impairments, such as physical, visual, or hearing impairments, and one or more of the objects may represent assistive devices, such as a walking cane, hearing aid, prosthesis, etc. Other objects may represent everyday items the user may use, such as a coffee mug, cell phone, keys, table, chair, etc.

The objects 117*a* . . . 117*n* respectively include transponders 119*a* . . . 119*n*. The transponders 119 are configured to transmit information about the objects information to corresponding receivers included in the computing device 101 and/or the vibrotactile system 115. In an example implementation, a transponder 119 may be an active or passive RFID tag and the computing device 101 and/or the vibrotactile system 115 may include a corresponding RFID reader (sensor 114), which is configured to energize and/or read the information on the tag using an electromagnetic field. In further implementations, the transponder 119 may be configured to transmit information to corresponding sensors in the computing device 101 and/or the vibrotactile system 115 using other suitable protocols, such as Bluetooth™, IrDA, various other IEEE 802 protocols, such as IEEE 802.15.4, or other suitable means. As shown in FIG. 1, the objects 117*a* . . . 117*n* may be coupled for communication with the other entities (e.g., 101, 115, etc.) using the network 105 via signal lines 106*a* . . . 106*n* and/or directly coupled for communication with the vibrotactile system 115 via signal lines 120*a* . . . 120*n* (representing direct connections, such as a wired connection and/or interface), respectively.

FIG. 2 is a block diagram of an example computing device 200. The computing device may include a sensing system 109, a processor 235, a memory 237, and a communication unit 241, and depending on which entity is represented by the computing device 200, it may further include one or more of the sensing system 109, the motor controller unit 110, the calibrator 118, the motor(s) 112, and the sensor(s) 114. For instance, the computing device 200 may represent the computing device 101, the vibrotactile system 115, and/or other entities of the system. The components 109, 110, 112, 114, 118, 235, 237, and/or 341 of the computing device 200 are electronically communicatively coupled by a bus 220. The computing device 200 may also include other suitable computing components understood as necessary to carry out its acts and/or provide its functionality.

The processor 235 includes an arithmetic logic unit, a microprocessor, a general-purpose controller, or some other processor array to perform computations and provide electronic display signals to a display device. The processor 235 is coupled to the bus 220 for communication with the other components. Processor 235 processes data signals and may include various computing architectures, such as but not limited a complex instruction set computer (CISC) architecture, a reduced instruction set computer (RISC) architecture, other instruction sets, an architecture implementing a combination of various instruction sets, etc. The processor 235 may represent a single processor or multiple processors and may reflect a monolithic or distributed processing architecture. Other processors, operating systems, sensors, displays and physical configurations are possible and contemplated.

The memory 237 stores software instructions and/or data that may be executed and/or processed by the processor 235, such as code for performing the techniques described herein. Example software instructions may include but are not limited to instructions comprising at least a portion of the sensing system 109, the motor control unit 110, and/or the calibrator 118, etc. The memory 237 is coupled to the bus 220 for communication with the other components of the computing device 200.

In some instances, the memory 237 may store a camera engine including logic operable by the processor 237 to control/operate the perceptual system. For example, the camera engine is a software driver executable by the processor 237 for signaling the camera to capture and store a still or motion image, controlling the flash, aperture, focal length, etc., of the camera, provide image data, detect objects in the image data, etc.

The memory 237 may be volatile and/or non-volatile memory and may include may include any suitable memory device or system. Example devices include but are not limited to dynamic random access memory (DRAM), static random access memory (SRAM), flash memory, hard disk drives, optical disc (e.g., CD, DVD, Blue-Ray™, etc.) devices, other mass storage devices for storing information on a more permanent basis, remote memory and/or storage systems, etc.

The communication unit 241 transmits and receives data to and from other nodes of the system 100, such as the computing device 101, the vibrotactile system 115, objects 117, etc., depending on which entity is represented. The communication unit 241 is coupled to the bus 220 for wireless and/or wired communication with the other components of the computing device 200. In some implementations, the communication unit 241 includes one or more wireless transceivers for exchanging data with the other entities of the system 100 using one or more wireless communication protocols, including IEEE 802.11, IEEE 802.16, BLUETOOTH®, or other suitable wireless communication protocols. In some implementations, the communication unit 241 includes port(s) for direct physical connection to the network 105 and/or other entities of the system 100 (e.g., objects 117, computing device 101, vibrotactile system 115), etc., depending on the configuration.

In some implementations, the communication unit 241 in a vibrotactile system 115 may be configured to communicate with the computing device 101 and/or objects 117 using various short, medium, and/or long-range communication protocols (RFID, NFC, Bluetooth®, Wi-Fi, Cellular, etc.). For instance, the communication unit 241 may include a sensor 114 for receiving data from the transponders 119 of the objects 117, as discussed elsewhere herein. As a further example, the sensor 114 may be an RFID reader configured to energize and receive tag ID data from the tag represented by a transponder 119 of an object 117, although other data exchange variations are also possible, as discussed elsewhere herein.

The sensing system 109 and/or other component so the system 100 can be implemented using hardware, software, and/or a combination thereof. For example, in some cases aspects of the system 109 may be implemented using hardware including a field-programmable gate array (FPGA) or an application-specific integrated circuit (ASIC), may be implemented as software stored in the memory 237 and executable by the processor 235, a combination thereof, etc.

As shown in FIG. 2, the sensing system 109 may include an interface module 202, an object identifier 204, an obstacle determination module 206, a position determination module 208, a trajectory generator 210, and a vibrotactile feedback (VF) module 212. In some implementations, each of the interface module 202, an object identifier 204, an obstacle determination module 206, a position determination module 208, a trajectory generator 210, and a vibrotactile feedback (VF) module 212 can include a set of instructions executable by the processor 235 to provide the acts and/or functionality described herein. In some further implementations, each of interface module 202, an object identifier 204, an obstacle determination module 206, a position determination module 208, a trajectory generator 210, and a vibrotactile feedback (VF) module 212 can be stored in the memory 237 of the computing device 200 and can be accessible and executable by the processor 235. The interface module 202, an object identifier 204, an obstacle determination module 206, a position determination module 208, a trajectory generator 210, and/or a vibrotactile feedback (VF) module 212 may be adapted for cooperation and communication with the processor 235 and other components of the computing device 200 via the bus 220.

Figure 3:
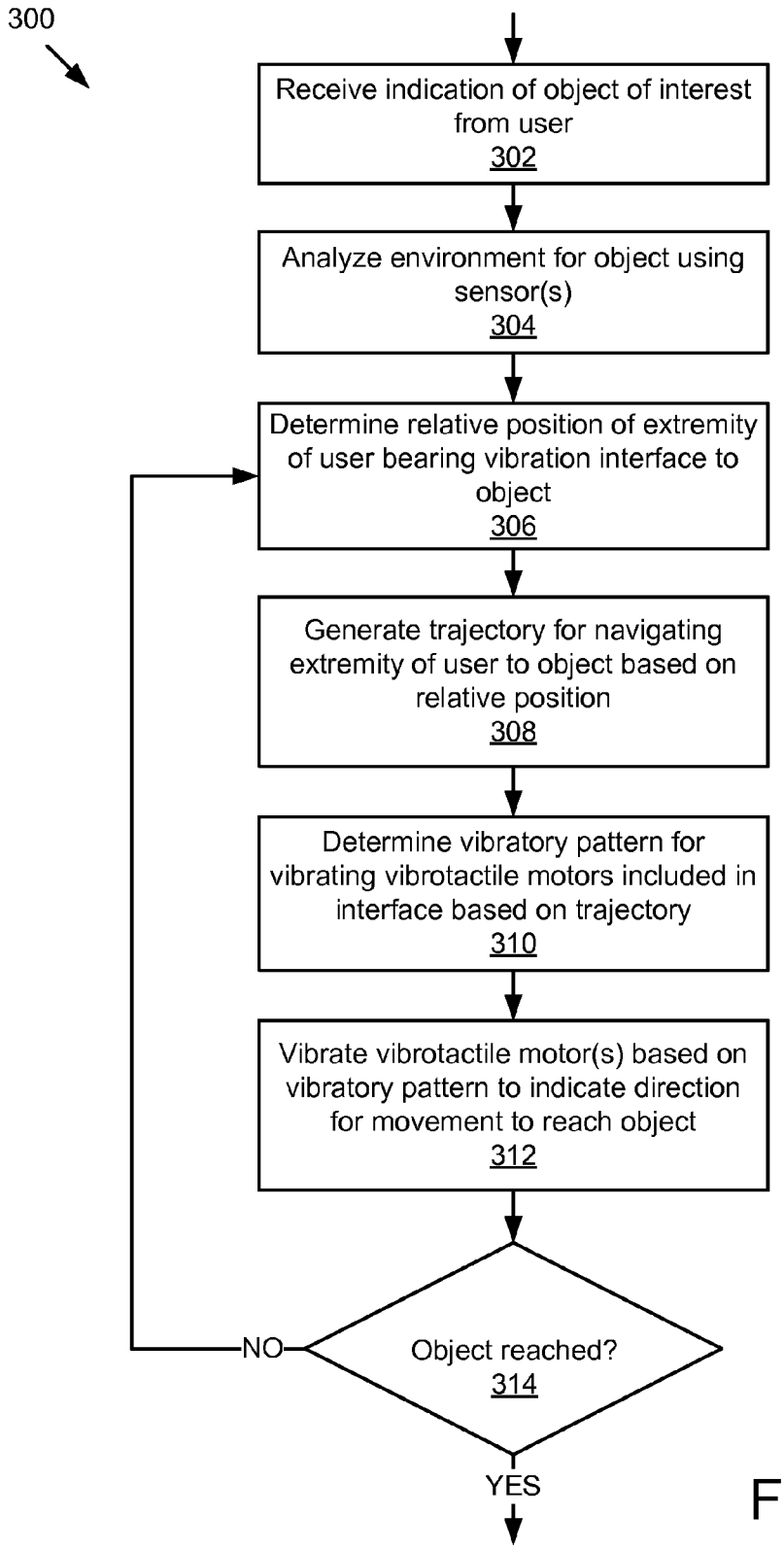
FIG. 3 is a flowchart of an example method for generating a trajectory for navigating a user extremity to a detected object and navigating the user extremity based thereon.

FIG. 3 is a flowchart of an example method 300 for generating a trajectory for navigating a user extremity to a detected object and navigating the user extremity based thereon. In block 302, the method 300 may receive an indication of an object of interest from the user. In some implementations, the interface module 202 may detect the indication of the object and provide data reflecting the indication to the object identifier 204, which may process the data to determine the unique identity of the object. For instance, the user may issue a voice command, which may be captured by a sensor 114 of the vibrotactile system 115 or the computing device 101 and detected by the interface module 202. In another example, the user may press a virtual or physical button included in the vibrotactile system 115 and/or the computing device 101 to indicate a given object of interest. Other variations are also possible.

In block 304, the method 300 may analyze the environment in which a user bearing a vibration interface is located for the object of interest using one or more sensors. In some implementations, the object identifier 204 may scan the environment using one or more sensors 114 of the vibrotactile system 115 or the computing device 101 for objects contained therein and determine whether any of those objects match the object of interest indicated by the user in block 302.

The objects in the environment may in some cases broadcast via radio frequency unique identifying information, which the sensor(s) 114 may receive and provide to the object identifier 204 for processing. The object identifier 204 may process the unique identifying information of each detected object by comparing it to unique identifying information of the object of interest, which may be retrievable from data storage (e.g., the memory 237, a database, remote data storage, etc.), to determine which object(s) in the environment match the indicated object of interest. The position determination module 208 may process the radio frequency signals broadcasted by the objects to determine their respective locations, for instance, using known micro-location techniques.

In some cases, the objects in the environment may be detected by one or more perceptual systems in cooperation with the sensing system 109. For example, as discussed elsewhere herein, the perceptual system (e.g., a sensor 114) may capture image data of the physical environment including objects included therein and the object identifier may receive the image data from the perceptual system and process it to detect objects included in the image data using standard image processing, object detection methods. Other variations and configurations are also contemplated and possible.

In block 306, the method 300 determines a relative position of the extremity of the user bearing the vibration interface to a position of the tangible object in the environment and generates in block 308 a trajectory for navigating the extremity of the user to the tangible object based on the relative position of the extremity to the position of tangible object.

In some implementations, the position determination module 208 determines the relative position of the extremity to the object and the trajectory generator 210 generates the trajectory based thereon. For instance, with a perceptual system, a form of object detection may be used to detect and determine the location of the object of interest. In addition, a method for detecting the position (location and/or orientation) of the extremity is also used if the sensor detecting the object is not embedded in or included on the vibration interface.

In some implementations, the position determination module 208 may execute operations for determining the relative positions between an extremity and objects including using a classifier engine (e.g., boosted Cascade), which may be included in the position determination module 208 or separate therefrom and executable by computing device 200, to detect objects in the image embodied by image data captured by the perceptual system, which may include physical objects in the environment and/or the user's extremity (e.g., hand). The position determine module 208 may use the image data and/or output from the classifier engine to identify the relative position of the extremity (whether detected or previously determined) to other detected object(s) in the image. For instance, the position determination module 208 could use depth data from an RGB-D camera or the like included in the perceptual system, could estimate the position(s) from the relative size(s) of the object(s) in the image, etc.

In some cases, the position determination module 208 can estimate the orientation of the extremity, for example, by determining a plurality of reference positions of the extremity and track the change in those positions over time to determine the current extremity orientation, although other variations are also possible and contemplated. The position determination module 208 may consider the motion of the extremity to determine the current and estimated future position of the extremity. The position determination module 208 may use the motion determination, the extremity orientation, position information of an object of interest, and/or other data to calculate the trajectory, as discussed elsewhere herein. For instance, the position denervation module may calculate a motion vector from the known positions of the object(s) of interest and the orientation and/or movement of the extremity.

In a further example, the sensing system 109 may search for a door handle in the environment using image data captured by a hand mounted camera. The sensing system 109 may analyze the images embodied by the image data from the camera using a classifier engine to find the door handle. The sensing system 109 would vibrate the vibration interface with the goal of situating the detected object in the center of the image. In this case, forward motion would move the extremity (e.g., hand) towards the door handle, and to that extent, the position determination module 208 may not be required to determine or estimate the actual distance to the object (e.g., at least not accurately), but can instead specify up, down, left, and right motions based on the distance of the center of the object in the image to the center of the image.

In some implementations, the position determination module 208 may determine the relative position of the extremity by determining an orientation of the extremity using sensing data captured by the one or more sensors. The sensing data reflects any movement of the extremity by the user. The position determination module 208 then calculates a ray originating from a predetermined point of the extremity and extending through a predetermined point of the tangible object and calculating the angular offset θ between the ray and the orientation of the extremity. The trajectory generator 210 may then use the angular offset to generate the trajectory for navigating the extremity of the user to the tangible object. Further illustrative techniques for determine the relative position and generating the trajectory are discussed herein with reference to at least FIGS. 4A and 4B.

Objects detected in the physical environment may have a fixed or variable location. When variable, the system 100 may be configured to track the change in location of those objects and dynamically guide the user to those objects using the techniques discussed herein. For instance, the position determination module 208 may detect movement in the environment by comparing a series of frames and detecting a change in the position of the object, and the position determination module 208 may process the image data to determine the current position of the objects within the environment, for example, using a Cartesian coordinate system and known reference points, such as its own position within the environment or other reference points included in the environment and reflected in the image data.

The method 300 may then guide the extremity of the user along the trajectory by vibrating the vibration interface. For example, the method 300 determines, in block 310, a vibratory pattern for vibrating one or more of the vibrotactile motors included in the vibration interface based on the trajectory generated in block 308 and vibrates the vibrotactile motor(s) 112 according to the vibratory pattern to convey the direction for movement by the user of the extremity to reach the tangible object. In some implementations, the vibrotactile feedback (VF) module 212 determines the vibratory pattern based on the trajectory received from the trajectory generator 210 and/or other signals, and interacts with the motor control unit 110 to vibrate the vibrotactile motor(s) 112, as discussed in further detail with reference to at least FIGS. 4A, 4B, and 5.

In block 314, the method 300 determines whether the object of interest has been reached, and if not, may repeat one or more of the preceding blocks 306, 308, 310, and/or 312 is needed to guide the extremity of the user to the object of interest. For example, the position determination module 208 may determine that the extremity of the user has reached the position of the tangible object within the physical environment and may signal the VF module 212 to terminate vibrating the vibration interface to cease guiding the extremity of the user. In response, the VF module 212 may signal the motor control unit 110 to stop vibrating the motor(s).

In some cases, the position determination module 28 may continuously (re)determine the relative position of the object to the extremity of the user as the position of the object and/or the extremity of the user changes due to movement. For example, the position determination module 208 may sense movement of the extremity by the user using the one or more sensors. For instance, the position determination module 208 may receive signals from a gyroscope, IMU, accelerometer, or other movement sensors included in the vibration interface configured to detect vertical, horizontal, and/or rotational movement of the extremity of the user, and may process those signals to determine a current position (e.g., orientation and location) of the extremity and whether the position is consistent with the trajectory.

Responsive to sensing the movement, the position determination module 208 may re-determine the relative position of the extremity of the user to the tangible object and update the trajectory for navigating the extremity of the user to the tangible object based on a change to the relative position of the extremity of the user to the tangible object. For instance, if the position of the extremity is not consistent with the trajectory, the position determination module 208 may signal the trajectory generator 210 to regenerate the trajectory using the updated position. The VF module 212 may then guiding the extremity of the user along the trajectory, as updated, by vibrating the vibration interface according to the updated trajectory.

Thus, in response to detected movement, the trajectory generator 210 may regenerate the trajectory if a different trajectory is needed based on a change in the relative position. Consequently, the vibrotactile feedback generated by the VF module 212 and provided to the user via the motor control unit 110 and the motor(s) 112 may be continuously adapted based on the user's movements to accurately guide the user's extremity to the object of interest.

Figure 4A:
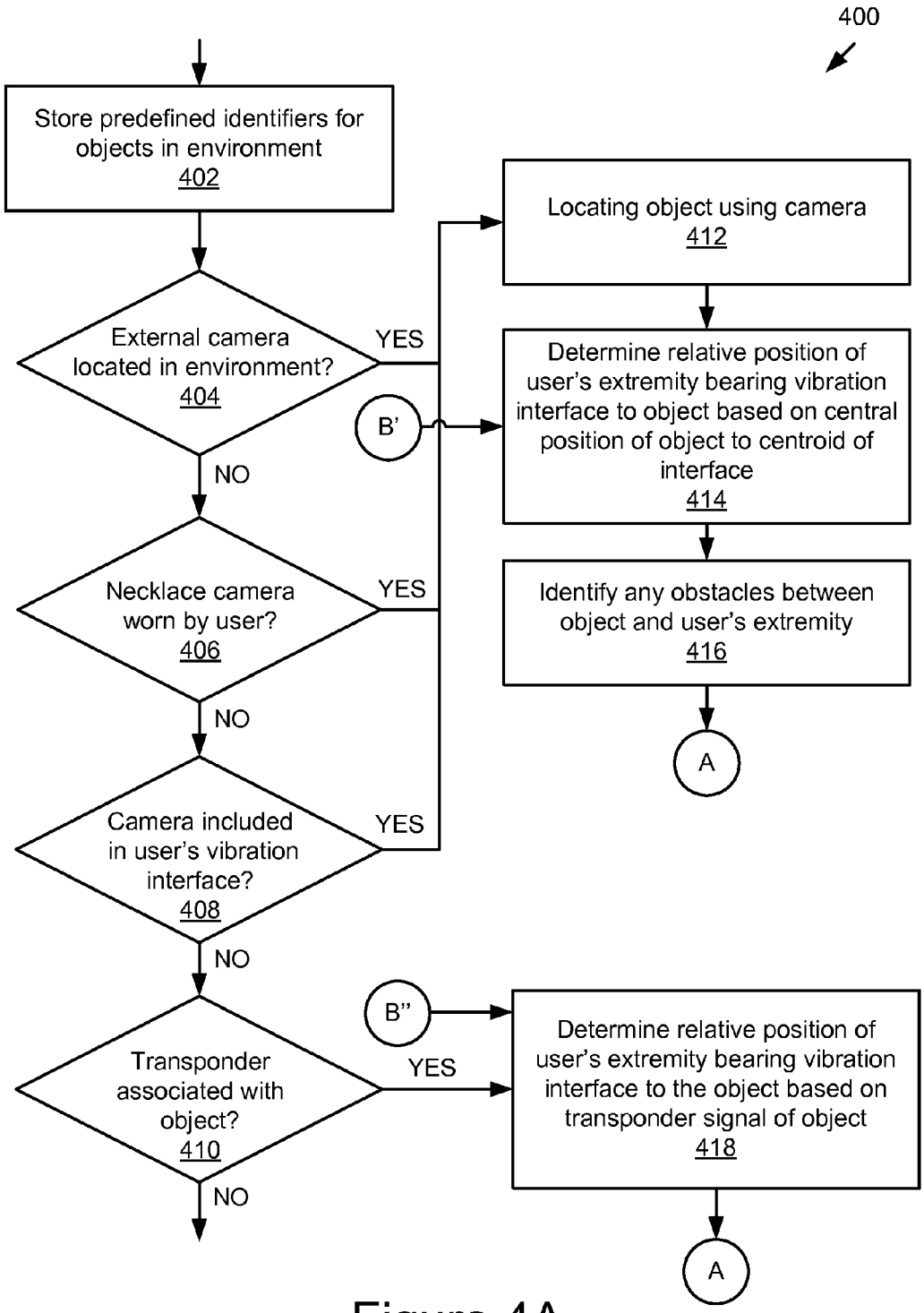
FIGS. 4A and 4B are flowcharts of a further example method for generating a trajectory for navigating a user extremity to a detected object and navigating the user extremity based thereon.
Figure 4B:
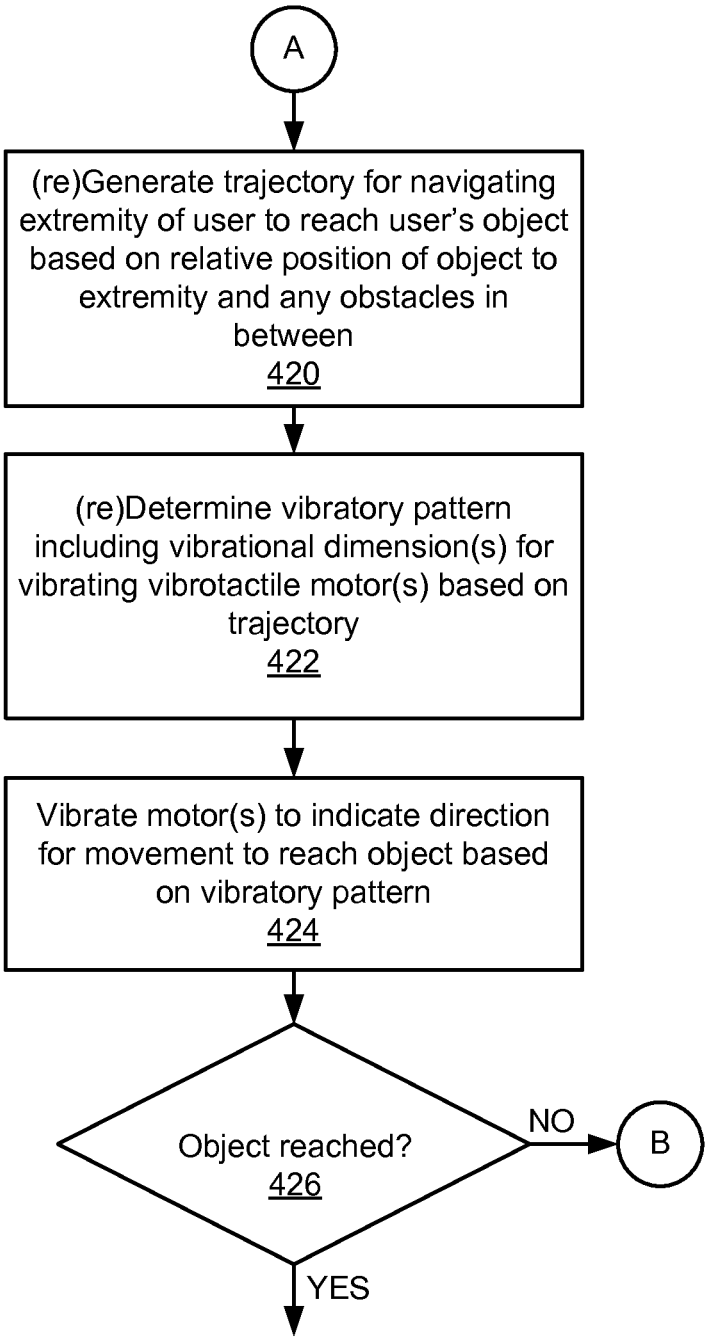

FIGS. 4A and 4B are flowcharts of a further example method 400 for generating a trajectory for navigating a user extremity to a detected object and navigating the user extremity based thereon.

In block 402, the method 400 stores predefined identifiers for objects in the physical environment. For example, a user or administrator using a computing device 101 may register objects within the environment with the sensing system 109. The sensing system 109 may generate and display a corresponding interface for inputting information about the objects, and the sensing system 109 may store that information in a data store, such as a remote storage system coupled to the network, the memory 237, or another storage device, for access and/or retrieval by the sensing system 109, such as the object identifier 204. In further embodiments, the sensing system 109 may automatically identify the objects within the environment (e.g., using information broadcasted by the objects, objects identified from image data, etc.) and store information about those objects in the data store. Other variations are also possible.

In blocks 404-410, the method 400 selects a means for locating the object of interest, such as a perceptual system or transponder. For instance, in block 404, the method 400 selects whether to use an external camera located in the physical environment; in block 406, the method 400 selects whether to use a necklace camera worn by the user; in block 408, the method 400 selects whether to use a camera included in a user's vibration interface; and in block 410, the method 400 selects whether to use a transponder associated with the tangible object. If, in blocks 404, 406, and 408, the selection is affirmative, the method 400 proceeds to use the selected camera to locate the object in block 412, as discussed elsewhere herein. Conversely, if in block 410, the selecting is affirmative, the method 400 proceeds to determine in block 418 the relative position of the user's extremity to the tangible object based on the transponder signal, as discussed elsewhere herein.

In block 414, the method 400 determines the relative position of the extremity of the user to the position of the tangible object within the physical environment. For instance, in doing so, the position determination module 208 determines a central position of the tangible object, determines a centroid of the vibration interface, and calculates the relative position based on a distance between the central position of object and the centroid of vibration interface.

In block 416, the method 400 identifies whether any obstacles exist within the physical environment between the tangible object and the extremity of the user using the one or more sensors. In some embodiments, the obstacle determination module 206 analyzes the image data captured by the camera to identify the obstacles, determines the position of the obstacles relative to the position of the object of interest and the position of the vibration interface, and provides that information to the trajectory generator 210 for use in generating the trajectory.

In block 420, the method 400 generates the trajectory for navigating the extremity of the user to the tangible object based on the relative position of the extremity to the position of tangible object and the position(s) of any obstacle(s) within the physical environment. By way of example, the trajectory may be based on a path that circumnavigates any detected obstacles.

In block 422, the method 400 determines a vibratory pattern including vibrational dimension(s) for vibrating one or more vibrotactile motors based on the trajectory generated in block 420. In some embodiments, the vibratory pattern includes one or more of linear motion and rotational dimensions that correspond to the movements that the user should perform to move his/her extremity toward the object. The VF module 212, via the motor control unit 110, then vibrates in block 424 the one or more motors based on the one or more of the directional and rotational dimensions of the vibratory pattern to convey the direction for movement of the extremity to reach the tangible object. As shown in block 426, the method 400 can iterate until the object has been successfully reached. For instance, if the object has not yet been reached, the method 400 may return to block 414 or 418 (depending on which operations are being used to locate the object). Otherwise, the method terminates or proceeds to another set of operations.

Figure 5:
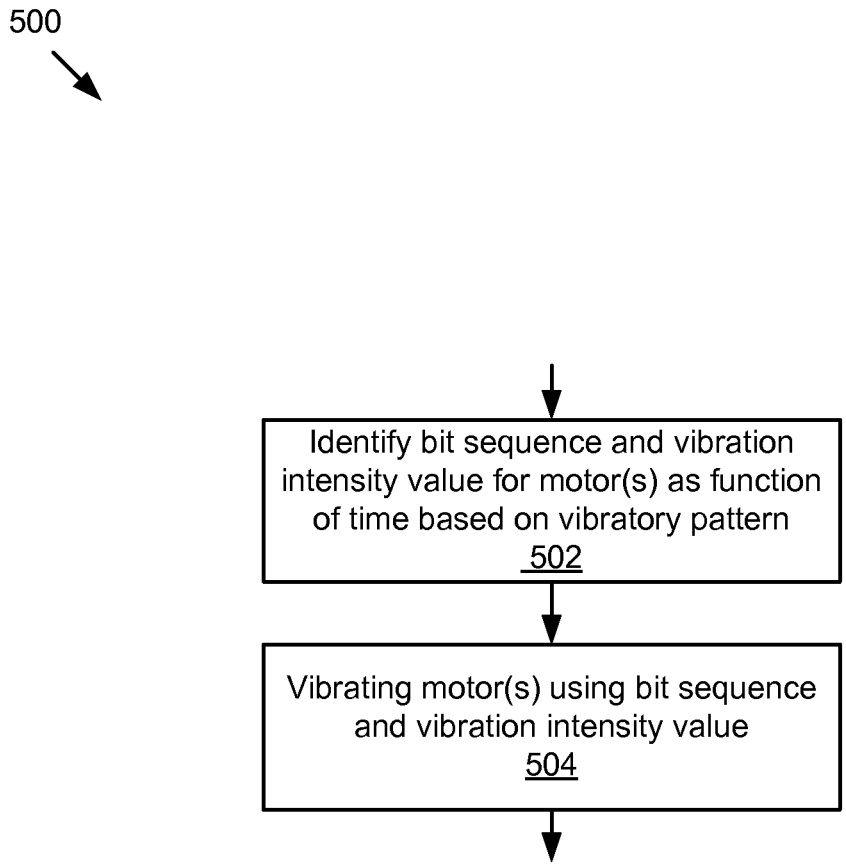
FIG. 5 is a flowchart of an example method for generating vibrotactile feedback.

FIG. 5 is a flowchart of an example method 500 for generating vibrotactile feedback. In block 502, the method 500 identifies a bit sequence and vibration intensity value for each of motors as a function of time based on the vibration pattern. By way of example, the bit sequence and vibration intensity value reflect directional and rotational dimension(s) of the vibratory pattern. For instance, for a left movement, the vibration pattern may activate the motors on the left side of the bearer's extremity, and the bit sequence for the motors includes bits turning on the left-side motors and bits turning off/keeping off the right-side motors. Additionally, the vibration intensity values for the left-side motors will correspond with the speed with which the user should move the extremity to the left (e.g., 1=slow, 2=moderately slow, 3=moderate, 4=moderately fast, 5=fast).

In block 504, the method 500 vibrates the one or motors of the vibration interface using the bit sequence and vibration intensity value(s). For example, the VF module 212 sends the bit sequence and the vibration intensity value(s) to the motor controller unit 110, which then uses the bit sequence and the vibration intensity value(s) to control/turn on/off the motors.

Figure 6:
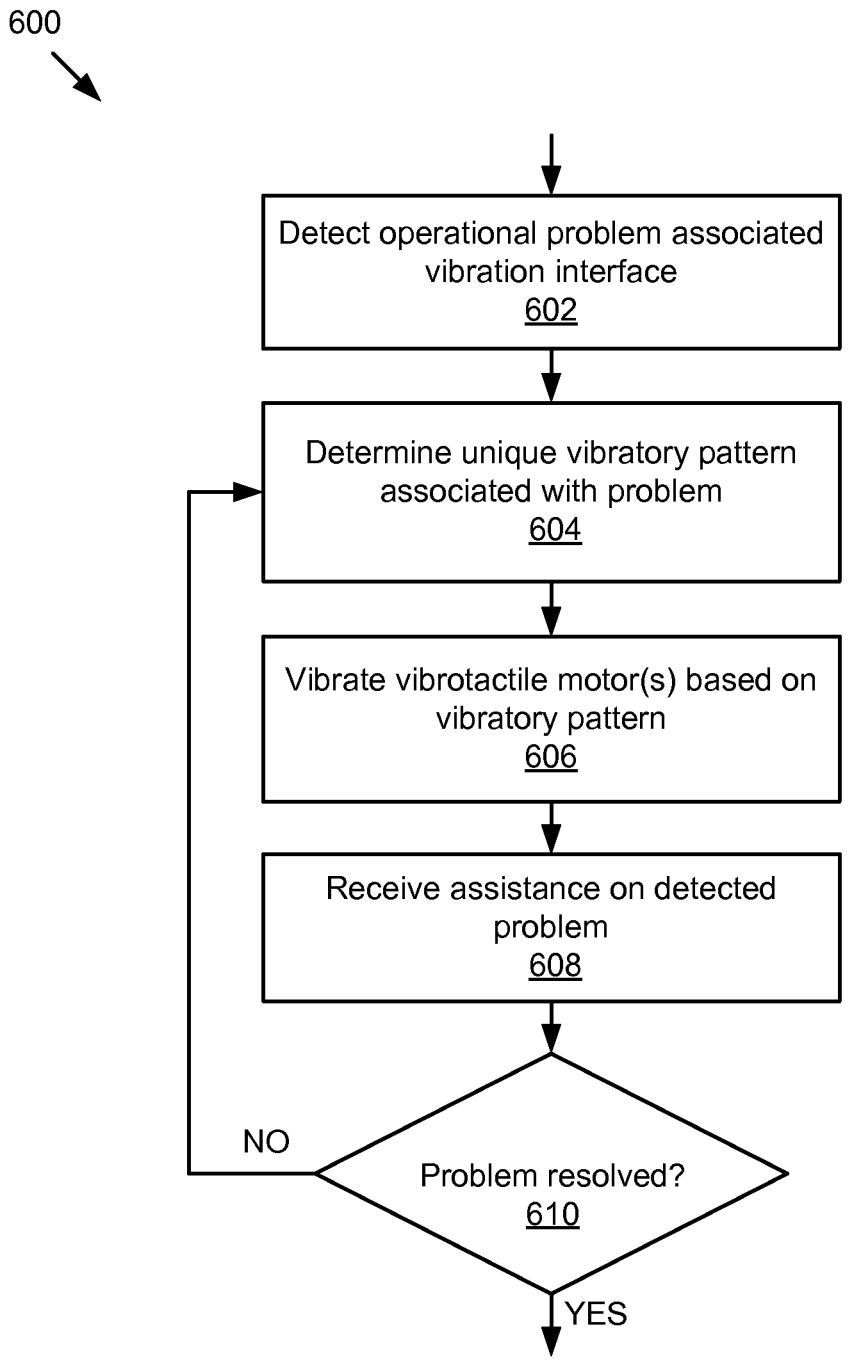
FIG. 6 is a flowchart of an example method for detecting and providing assistance on an operational problem associated with a vibrotactile band.

FIG. 6 is a flowchart of an example method 600 for detecting and providing assistance on an operational problem associated with a vibrotactile band. In block 602, the sensing system 109 detects an operational problem associated with the vibration interface. Responsive thereto, sensing system 109 determines in block 604 a unique vibratory pattern for the operational problem. For instance, a list of operation problems may be stored in the memory 237 and the sensing system 109 may query the list using characteristics describing the operation problem (e.g., an error code, etc.) and return the vibratory patter associated with that operational problem. In cases where the operation problem is undefined, a corresponding vibratory pattern for undefined problems may be returned.

In block 606, the VF module 212 vibrates the vibration interface based on the unique vibratory pattern. Responsive to the vibration, the bearer of the interface provides input via an input device providing assistance to address the operational problem, which the sensing system 109 receives in block 608 and uses to resolve the operation problem (e.g., resets the vibratory interface, clears the memory 237, receives a location, receives identification of an object, etc.). If the problem is not resolved, the method 600 may return to block 604 and repeat. Otherwise, the method 600 may end or proceed to perform other operations, such as those discussed elsewhere herein.

For reference, FIGS. 7A-11B are described above.

In the above description, for purposes of explanation, numerous specific details are set forth in order to provide a thorough understanding of the present disclosure. However, it should be understood that the technology described herein can be practiced without these specific details. Further, various systems, devices, and structures are shown in block diagram form in order to avoid obscuring the description. For instance, various embodiments are described as having particular hardware, software, and user interfaces. However, the present disclosure applies to any type of computing device that can receive data and commands, and to any peripheral devices providing services.

In some instances, various embodiments may be presented herein in terms of algorithms and symbolic representations of operations on data bits within a computer memory. An algorithm is here, and generally, conceived to be a self-consistent set of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout this disclosure, discussions utilizing terms including "processing," "computing," "calculating," "determining," "displaying," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Various embodiments described herein may relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, including, but is not limited to, any type of disk including floppy disks, optical disks, CD-ROMs, and magnetic disks, read-only memories (ROMs), random access memories (RAMs), EPROMs, EEPROMs, magnetic or optical cards, flash memories including USB keys with non-volatile memory or any type of media suitable for storing electronic instructions, each coupled to a computer system bus.

The technology may be implemented in hardware and/or software, which includes but is not limited to firmware, resident software, microcode, etc. Furthermore, the technology can take the form of a computer program product accessible from a computer-usable or computer-readable medium providing program code for use by or in connection with a computer or any instruction execution system. For the purposes of this description, a computer-usable or computer readable medium can be any non-transitory storage apparatus that can contain, store, communicate, propagate, or transport the program for use by or in connection with the instruction execution system, apparatus, or device.

A data processing system suitable for storing and/or executing program code may include at least one processor coupled directly or indirectly to memory elements through a system bus. The memory elements can include local memory employed during actual execution of the program code, bulk storage, and cache memories that provide temporary storage of at least some program code in order to reduce the number of times code must be retrieved from bulk storage during execution. Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems, storage devices, remote printers, etc., through intervening private and/or public networks. Wireless (e.g., Wi-Fi™) transceivers, Ethernet adapters, and modems, are just a few examples of network adapters. The private and public networks may have any number of configurations and/or topologies. Data may be transmitted between these devices via the networks using a variety of different communication protocols including, for example, various Internet layer, transport layer, or application layer protocols. For example, data may be transmitted via the networks using transmission control protocol/Internet protocol (TCP/IP), user datagram protocol (UDP), transmission control protocol (TCP), hypertext transfer protocol (HTTP), secure hypertext transfer protocol (HTTPS), dynamic adaptive streaming over HTTP (DASH), real-time streaming protocol (RTSP), real-time transport protocol (RTP) and the real-time transport control protocol (RTCP), voice over Internet protocol (VOIP), file transfer protocol (FTP), WebSocket (WS), wireless access protocol (WAP), various messaging protocols (SMS, MMS, XMS, IMAP, SMTP, POP, WebDAV, etc.), or other known protocols.

Finally, the structure, algorithms, and/or interfaces presented herein are not inherently related to any particular computer or other apparatus. Various general-purpose systems may be used with programs in accordance with the teachings herein, or it may prove convenient to construct more specialized apparatus to perform the required method blocks. The required structure for a variety of these systems will appear from the description above. In addition, the specification is not described with reference to any particular programming language. It will be appreciated that a variety of programming languages may be used to implement the teachings of the specification as described herein.

The foregoing description has been presented for the purposes of illustration and description. It is not intended to be exhaustive or to limit the specification to the precise form disclosed. Many modifications and variations are possible in light of the above teaching. It is intended that the scope of the disclosure be limited not by this detailed description, but rather by the claims of this application. As will be understood by those familiar with the art, the specification may be embodied in other specific forms without departing from the spirit or essential characteristics thereof. Likewise, the particular naming and division of the modules, routines, features, attributes, methodologies and other aspects are not mandatory or significant, and the mechanisms that implement the specification or its features may have different names, divisions and/or formats.

Furthermore, the modules, routines, features, attributes, methodologies and other aspects of the disclosure can be implemented as software, hardware, firmware, or any combination of the foregoing. Also, wherever a component, an example of which is a module, of the specification is implemented as software, the component can be implemented as a standalone program, as part of a larger program, as a plurality of separate programs, as a statically or dynamically linked library, as a kernel loadable module, as a device driver, and/or in every and any other way known now or in the future. Additionally, the disclosure is in no way limited to implementation in any specific programming language, or for any specific operating system or environment. Accordingly, the disclosure is intended to be illustrative, but not limiting, of the scope of the subject matter set forth in the following claims.

We claim:

1. A method comprising:

analyzing a physical environment in which a user bearing a vibration interface including a plurality of motors is located for a tangible object within a field of view using one or more sensors coupled to electronically communicate with the vibration interface;

determining a relative position of an extremity of the user bearing the vibration interface to a position of the tangible object within the physical environment;

generating a trajectory for navigating the extremity of the user to the tangible object based on the relative position of the extremity to the position of tangible object; and guiding the extremity of the user along the trajectory by vibrating one or more of the motors of the vibration interface.

2. The method of claim 1, further comprising:

sensing movement of the extremity by the user using the one or more sensors;

responsive to sensing the movement, re-determining the relative position of the extremity of the user to the tangible object;

updating the trajectory for navigating the extremity of the user to the tangible object based on a change to the relative position of the extremity of the user to the tangible object; and guiding the extremity of the user along the trajectory, as updated, by vibrating the one or more of the motors of the vibration interface.

3. The method of claim 1, wherein determining the relative position of the extremity includes determining an orientation of the extremity using sensing data captured by the one or more sensors, the sensing data reflecting movement of the extremity by the user, calculating a ray originating from a predetermined point of the extremity and extending through a predetermined point of the tangible object, and calculating an angular offset $\theta$ between the orientation of the extremity and the ray, and generating the trajectory for navigating the extremity of the user to the tangible object is based on the angular offset.

4. The method of claim 1, further comprising: determining a vibratory pattern for vibrating the one or more of the motors of the vibration interface based on the trajectory generated for navigating the extremity of the user to the tangible object, wherein guiding the extremity of the user along the trajectory by vibrating the one or more of the motors of the vibration interface further includes vibrating the one or more of the motors according to the vibratory pattern to convey a direction for movement of the extremity to reach the tangible object.

5. The method of claim 4, wherein the vibratory pattern includes one or more of linear motion and rotational dimensions and vibrating the one or more of the motors of the vibration interface includes vibrating the one or more of the motors based on the one or more of the linear motion and rotational dimensions of the vibratory pattern to convey the direction for movement of the extremity to reach the tangible object.

6. The method of claim 5, further comprising:

identifying a bit sequence and vibration intensity value for the one or more of the motors, the bit sequence and vibration intensity value reflecting the one or more of the linear motion and rotational dimensions of the vibratory pattern, wherein vibrating the one or more of the motors of the vibration interface includes vibrating the one or more of the motors using the bit sequence and vibration intensity value.

7. The method of claim 1, further comprising:

determining that the extremity of the user has reached the position of the tangible object within the physical environment; and terminating vibrating the one or more of the motors of the vibration interface to cease guiding the extremity of the user.

8. The method of claim 1, wherein the position of the tangible object is fixed or variable.

9. The method of claim 1, wherein determining the relative position of the extremity of the user to the position of the tangible object within the physical environment includes determining a central position of the tangible object, determining a centroid of the vibration interface, and calculating the relative position based on a distance between the central position of the tangible object and the centroid of vibration interface.

10. The method of claim 1, further comprising:

identifying an obstacle within the physical environment between the tangible object and the extremity of the user using the one or more sensors, wherein generating the trajectory for navigating the extremity of the user to the tangible object based on the relative position of the extremity to the position of tangible object is further based on a path that circumnavigates the obstacle.

11. The method of claim 1, wherein analyzing the physical environment in which the user is located for the tangible object using one or more sensors includes locating the tangible object within the physical environment using a visual perception system.

12. The method of claim 1, further comprising:

detecting an operational problem associated with the vibration interface;

determining a unique vibratory pattern for the operational problem;

vibrating one or more of the motors of the vibration interface based on the unique vibratory pattern; and receiving input from the user via an input device providing assistance to address the operational problem.

13. The method of claim 1, further comprising:

receiving input data from the user via an input device indicating the tangible object as an object of interest.

14. A system comprising:

a vibration interface wearable on an extremity by a user, the vibration interface including a plurality of motors;

one or more sensors coupled to the vibration interface;

a sensing system coupled to the one or more sensors and the vibration interface, the sensing system being configured to analyze a physical environment in which the user is located for a tangible object within a field of view using the one or more sensors, to generate a trajectory for navigating the extremity of the user to the tangible object based on a relative position of the extremity of the user bearing the vibration interface to a position of the tangible object within the physical environment, and to guide the extremity of the user along the trajectory by vibrating the vibration interface.

15. The system of claim 14, comprising:

an input device configured to receive input data from the user indicating the tangible object, the input device being coupled to the sensing system to communicate data reflecting the tangible object to the sensing system.

16. The system of claim 14, wherein the one or more sensors are further configured to receive transponder signals from the tangible object, the transponder signals including identification data identifying the tangible object, and the sensing system being executable by the one or more processors to determine a unique identify of the tangible object based on the identification data.

17. The system of claim 14, wherein the one or more sensors include a perceptual system configured to capture image data including images of the physical environment and objects located with the physical environment, the perceptual system being coupled to the sensing system to provide the image data including the images, and the sensing system being further configured to process the image data to determine a location of the tangible object.

18. The system of claim 14, wherein the sensing system is further configured to determine the relative position of the extremity of the user bearing the vibration interface.

19. The system of claim 14, wherein the sensing system is further configured to sense movement of the extremity by the user using the one or more sensors, to re-determine the relative position of the extremity of the user to the tangible object responsive to sensing the movement, to update the trajectory for navigating the extremity of the user to the tangible object based on a change to the relative position of the extremity of the user to the tangible object, and to guide the extremity of the user along the updated trajectory, as updated, using the vibration interface.

20. The system of claim 14, wherein the sensing system is further configured to determine a vibratory pattern for vibrating one or more of the motors of the vibration interface based on the trajectory generated for navigating the extremity of the user to the tangible object and to vibrate the vibration interface by vibrating the one or more of the motors according to the vibratory pattern to convey a direction for movement of the extremity to reach the tangible object.

21. The system of claim 20, further comprising:

a motor control unit configured to vibrate the one or more of the motors of the vibration interface according to the vibratory pattern determined by the sensing system, the motor control unit being coupled to the sensing system to receive control signals.

* * * * *